US006916186B2

(12) United States Patent
Szu et al.

(10) Patent No.: US 6,916,186 B2
(45) **Date of Patent: *Jul. 12, 2005**

(54) ELETRICAL CONTACT WITH DUAL ELECTRICAL PATHS

(75) Inventors: Ming-Lun Szu, Tu-chen (TW); Fang-Jwu Liao, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 10/658,430

(22) Filed: Sep. 8, 2003

(65) Prior Publication Data

US 2004/0180560 A1 Sep. 16, 2004

(30) Foreign Application Priority Data

Mar. 12, 2003 (TW) ..... 92203733 U

(51) Int. Cl.[7] ..... H01R 4/58
(52) U.S. Cl. ..... 439/86
(58) Field of Search ..... 439/86, 515, 66

(56) References Cited

U.S. PATENT DOCUMENTS 4,553,192 A 11/1985 Babuka et al.
5,395,252 A 3/1995 White
5,984,693 A * 11/1999 McHugh et al. ..... 439/66
6,000,969 A * 12/1999 Reichardt et al. ..... 439/630
6,164,978 A * 12/2000 McHugh et al. ..... 439/66
6,203,331 B1 3/2001 McHugh et al.
6,227,869 B1 * 5/2001 Lin et al. ..... 439/66
6,290,507 B1 * 9/2001 Neidich et al. ..... 439/66
6,296,495 B1 10/2001 Wang et al.
6,749,440 B1 * 6/2004 Szu et al. ..... 439/66

FOREIGN PATENT DOCUMENTS

JP 864285 3/1996
JP 8162238 6/1996
JP 200160483 3/2001

* cited by examiner

*Primary Examiner*—Phuong Dinh
(74) *Attorney, Agent, or Firm*—Wei Te Chung

(57) ABSTRACT

An electrical contact (1) for electrically interconnecting two electrical components (3, 4) includes an inverted "U"-shaped retention portion (11), a substantially "U"-shaped extending portion extending (12) from the retention portion. The extending portion defines first and second mating portions (122, 121) respectively at uppermost and lowermost sections thereof, for engaging with the electrical components. The extending portion forms an engaging portion (125) to mate with the retention portion. Thus two parallel electrical paths are formed between the first and second mating portions when the contact electrically mates with the two electrical components. As a result, impedance of the contact is decreased and good resilient characteristics of the contact are attained.

16 Claims, 4 Drawing Sheets

ELETRICAL CONTACT WITH DUAL ELECTRICAL PATHS

BACKGROUND OF THE INVENTION

1. Field of the Invention

The present invention relates to an electrical contact, and more particularly to an electrical connector contact for electrically interconnecting two electrical components such as an integrated circuit (IC) package and a printed circuit board (PCB).

2. Description of the Prior Art

There are two current trends in the connector industry which pose great challenges for manufacturers: the trend toward miniaturization of socket connectors, and the trend toward increased density of arrays of electrical contacts of the socket connectors. In a typical miniaturized socket connector, each contact received in a housing of the connector is short and occupies only a limited space. Thus a spring arm of the contact is too short to provide good resilient characteristics. As a result, engagement between the connector and an associated electrical device may be unreliable.

In order to overcome the above problems, U.S. Pat. Nos. 6,203,331 and 6,296,495 provide another kind of electrical connector. Referring to FIGS. 5 and 6, the connector comprises a housing 8, and a plurality of electrical contacts 9 received in the housing 8. A plurality of contact-passages 81 is defined in the housing 8, the contact-passages 81 receiving the corresponding contacts 9 therein. Each contact 9 has an inverted "U"-shaped retention portion 91, and a "U"-shaped extending portion 92 extending slantingly down from the retention portion 91. A first mating portion 922 is defined at a bottommost section of the extending portion 92. The first mating portion 922 protrudes out from the housing 8, for engaging with a corresponding contact pad 830 of a PCB 83. A second mating portion 921 is formed at a topmost section of the extending portion 92. The second mating portion 921 protrudes out from the housing 8, for engaging with a corresponding contact pad 820 of an IC package 82. With this structure, the extending portion 92 is relatively long, and gives the contact 9 good resilient characteristics.

However, the elongate extending portion 92 increases a length of an electrical path along an "L"-shaped portion of the contact 9 between the first and second mating portions 922, 921. Thus impedance of the contact 9 is increased. Further, the contacts 9 are densely arrayed in the housing 8. As a result, much heat is generated and concentrated in the connector during operation. The connector and the IC package 82 are liable to malfunction, and may even be damaged.

Accordingly, there is a need to provide an improved electrical contact for a connector which overcomes the above-mentioned problems.

SUMMARY OF THE INVENTION

Accordingly, a main object of the present invention is to provide an electrical contact having both low impedance and good resilient characteristics.

To fulfill the above-mentioned object, an electrical contact is provided according to the present invention, for electrically interconnecting with two electrical components. The contact comprises an inverted "U"-shaped retention portion and a substantially "U"-shaped extending portion extending slantwise from the retention portion. First and second mating portions are formed at topmost and bottommost sections of the extending portion, for respectively engaging with the electrical components.

With this structure, the extending portion of the contact is relatively long, and gives the contact good resilient characteristics. Additionally, an engaging portion is formed on the extending portion, for engaging the retention portion. Thus two parallel electrical paths are formed between the first and second mating portions when the contact electrically mates with the two electrical components. As a result, impedance of the contact is decreased.

Other objects, advantages and novel features of the present invention will become more apparent from the following detailed description when taken in conjunction with the accompanying drawings, in which:

DESCRIPTION OF PREFERRED EMBODIMENT OF THE INVENTION

Reference will now be made to the drawings to describe the present invention in detail.

Figure 1:
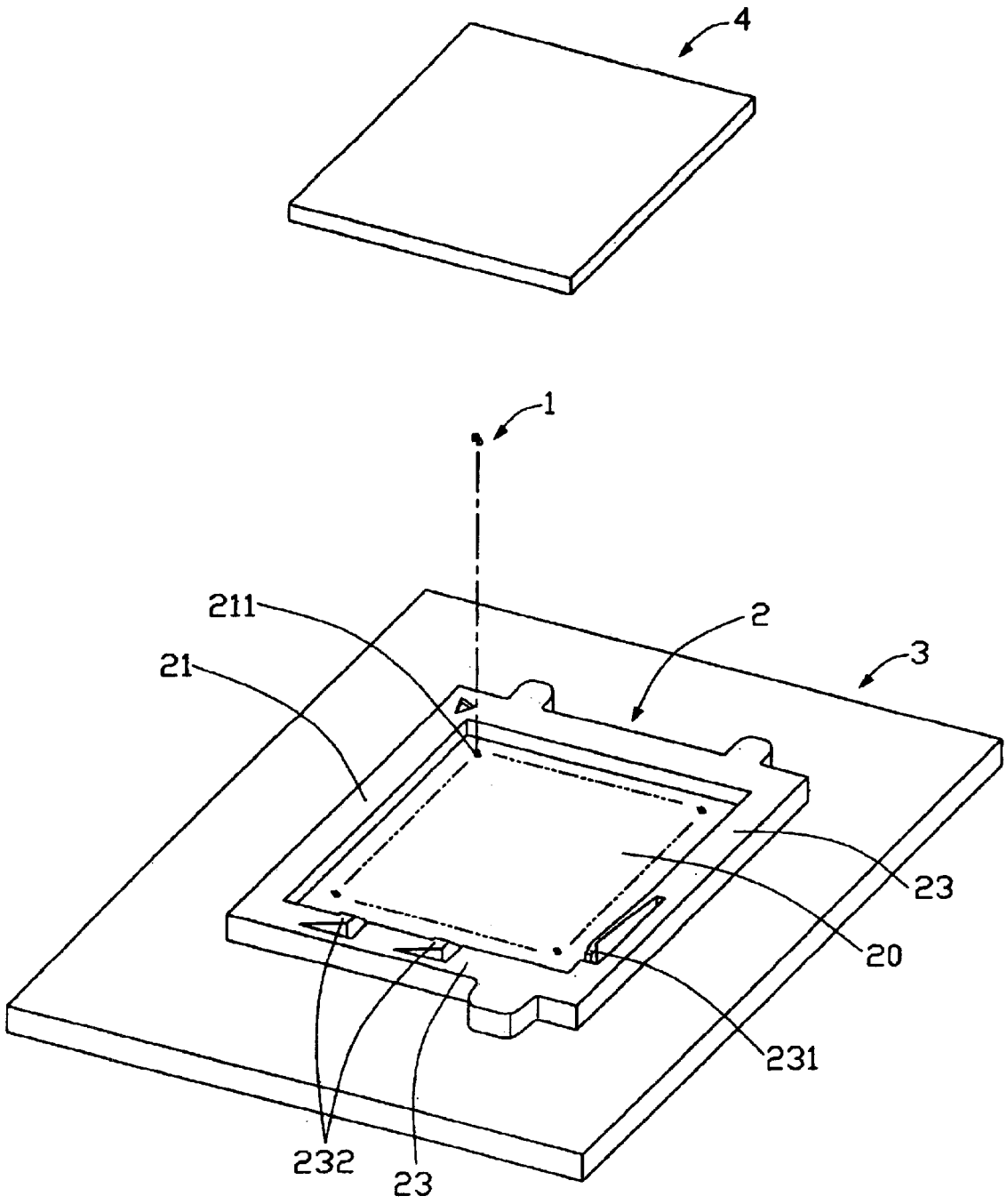
FIG. 1 is a simplified, isometric view of an electrical connector comprising electrical contacts according to the present invention, together with a PCB on which the connector is mounted, and an IC package ready to be attached to the connector.
Figure 4:
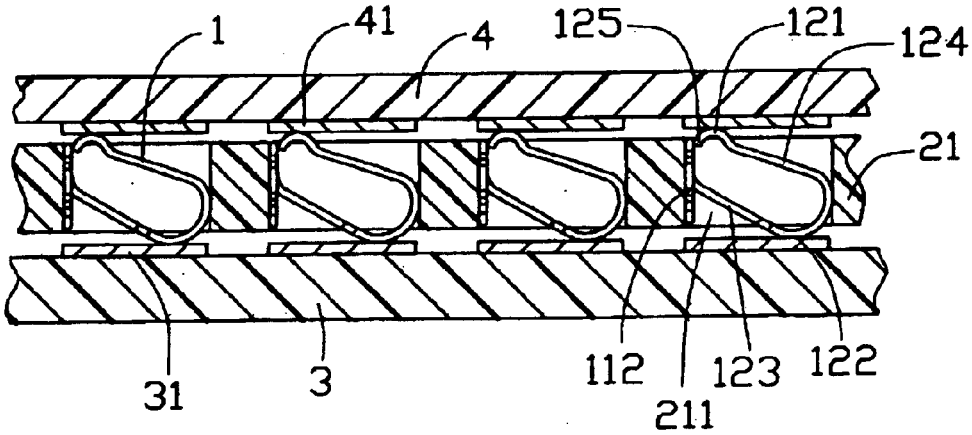
FIG. 4 is similar to FIG. 3, but showing the IC package and the PCB connected with the connector.
Figure 5:
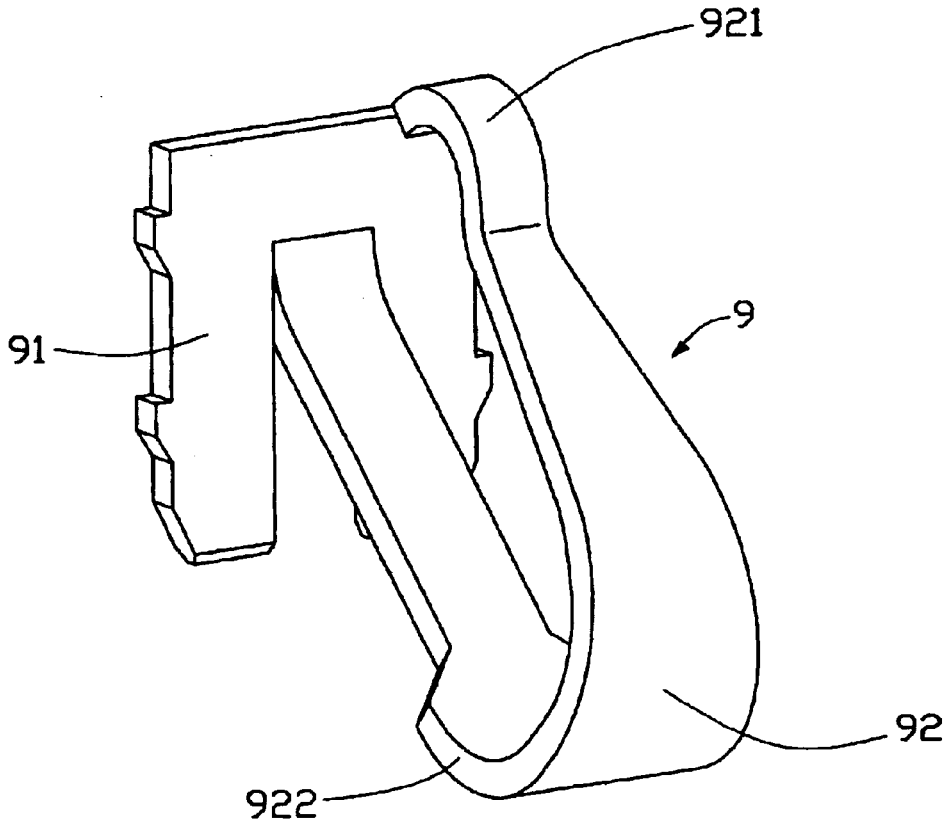
FIG. 5 (PRIOR ART)
FIG. 5 is an isometric view of a conventional electrical contact.
Figure 6:
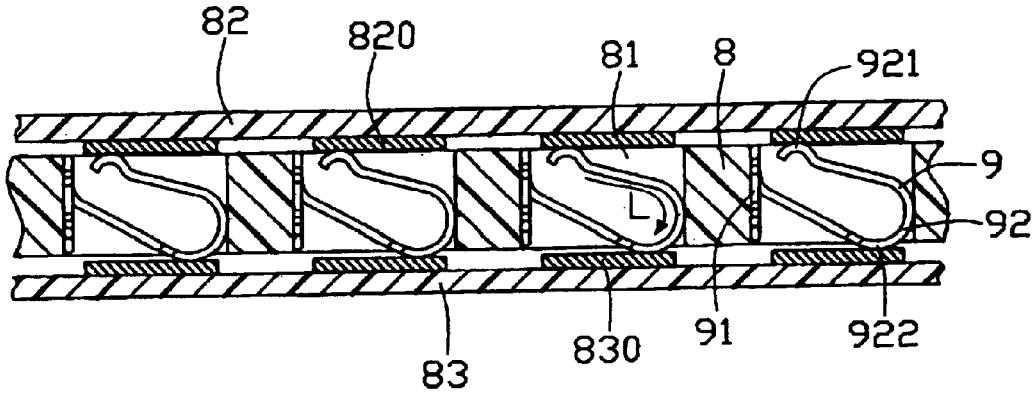
FIG. 6 (PRIOR ART)
FIG. 6 is a cross-sectional view of part of a housing of a conventional connector, the housing defining contact-passages receiving contacts in accordance with the contact of FIG. 5, the connector being connected with an IC package and a PCB, the IC package and the PCB being shown in cross-section.

FIG. 1 shows an electrical connector 2 incorporating a plurality of electrical contacts 1 (only one illustrated) according to the present invention. Referring also to FIG. 4, the electrical connector 2 is for electrically interconnecting two electrical components, such as a PCB 3 and an IC package 4 via respective contact pads 31, 41 thereof. The electrical connector 2 comprises a generally rectangular housing 21, and the electrical contacts 1 received in the housing 21. The electrical connector 2 is typically an LGA connector.

The housing 21 has four side walls 23, which cooperatively define an opening 20 therebetween. An array of contact-passages 211 is defined in the housing 21 below the opening 20, the contact-passages 211 receiving the corresponding contacts 1 therein. A first spring cantilever 231 extends from an inner side of one side wall 23 into the opening 20. Two spaced second spring cantilevers 232 extend from an inner side of an adjacent side wall 23 into the opening 20. The first and second spring cantilevers 231, 232 are adapted to resiliently secure the IC package 4 in the opening 20 of the housing 21. A plurality of posts (not shown) is formed on a bottom surface of the housing 21. A plurality of holes (not shown) is defined in the PCB 3, the holes receiving the corresponding posts therein so as to position the electrical connector 2 on the PCB 3.

Figure 2:
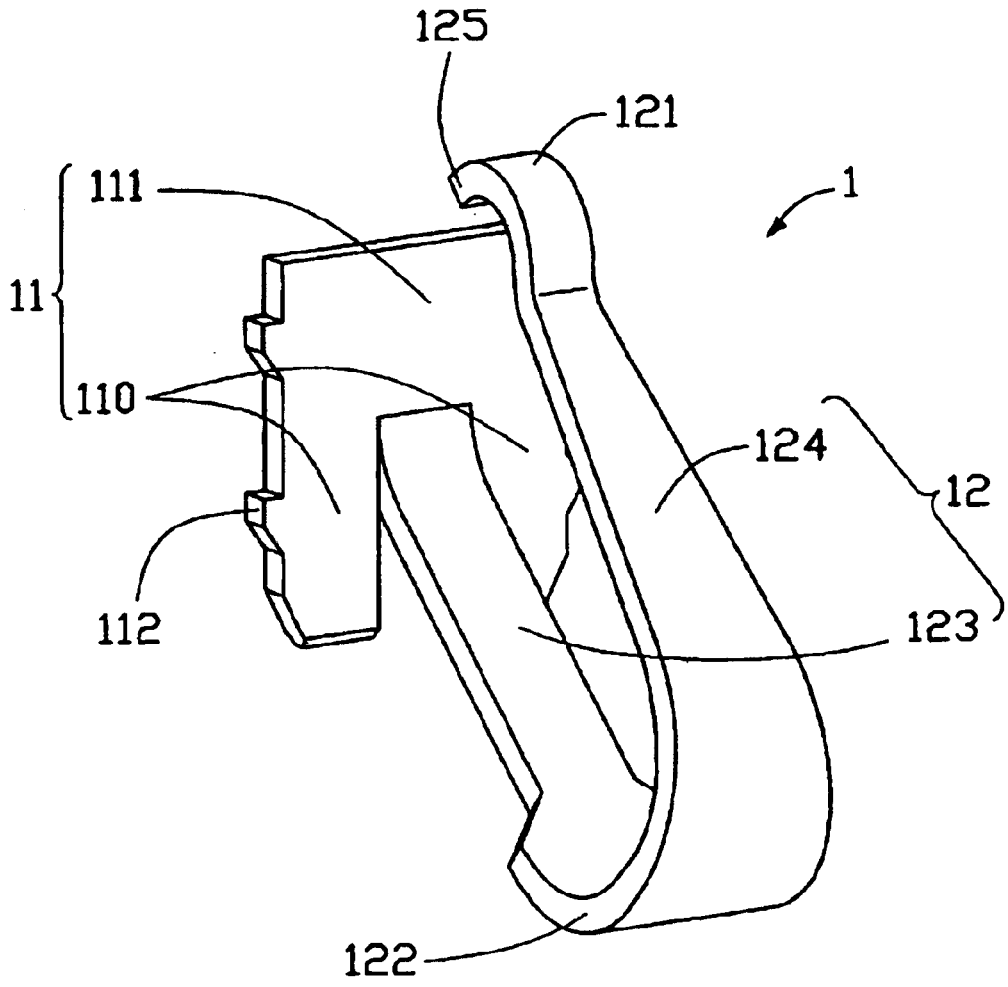
FIG. 2 is an enlarged, isometric view of one contact shown in FIG. 1.

Referring to FIG. 2, each contact 1 comprises an inverted "U"-shaped retention portion 11. The retention portion 11 comprises two opposite parallel retention legs 110 interconnected by a transverse connecting portion 111. A pair of protruding barbs 112 is formed on an outer longitudinal edge of each leg 110, for securing the contact 1 in a corresponding contact-passage 211.

An extending portion 12 extends slantingly downwardly from a middle of the connecting portion 111. The extending portion 12 has a substantially "U"-shaped configuration, being oriented slantwise relative to the retention portion 11. The extending portion 12 comprises opposite first and second spring arms 123, 124. The first spring arm 123 extends slantingly down from the middle of the connecting portion 111. A first mating portion 122 is defined at a bottommost section of the first spring arm 123, for engaging with a corresponding pad 31 of the PCB 3. The second spring arm 124 extends slantingly up from the first mating portion 122 of the first spring arm 123. A second mating portion 121 is formed at a topmost section of the second spring arm 124, for engaging with a corresponding pad 41 of the IC package 4. In addition, an engaging portion 125 is formed at a free end of the second spring arm 124, adjacent the second mating portion 121.

With this structure, the extending portion 12 of the contact 1 is relatively long, giving the contact 1 good resilient characteristics.

Figure 3:
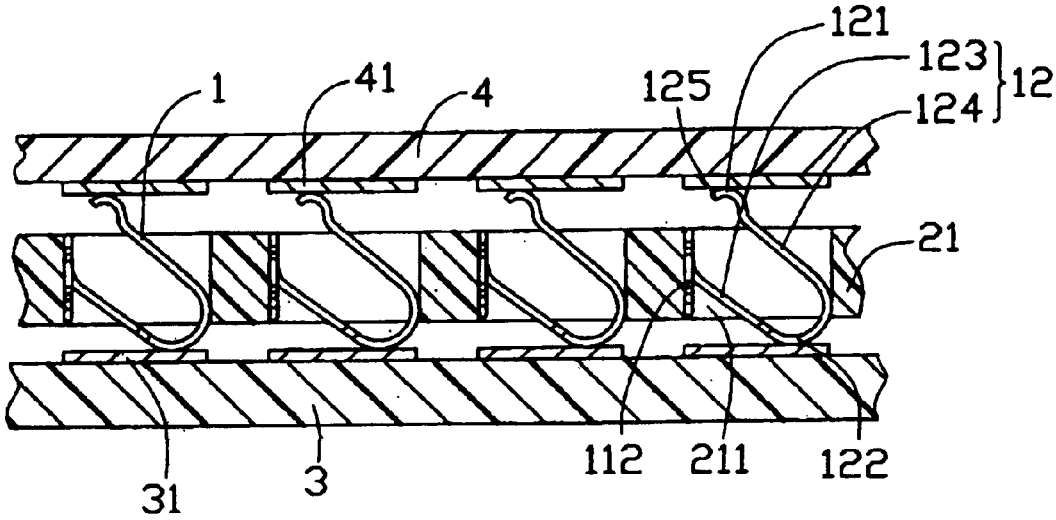
FIG. 3 is a cross-sectional view of part of a housing of the connector of FIG. 1, showing contacts received in contact-passages of the housing prior to the IC package and the PCB being connected with the connector, the IC package and the PCB being shown in cross-section.

Referring to FIG. 3, in assembly of the electrical connector 2, the contacts 1 are received in the corresponding contact-passages 211 of the housing 21. The barbs 112 of each contact 1 interferingly engage with interior surfaces of the housing 21 at the corresponding contact-passage 211, so that the contact 1 is firmly secured in the contact-passage 211. The first mating portion 122 protrudes below the housing 21, for engaging with the corresponding pad 31 of the PCB 3. The second mating portion 121 protrudes above the housing 21, for engaging with the corresponding pad 41 of the IC package 4.

Referring to FIG. 4, in use, the pads 31, 41 of the PCB 3 and the IC package 4 respectively press the first and second mating portions 122, 121 of each contact 1 in opposite directions. Due to the good resilient characteristics of the contact 1, relatively little pressing force needs to be applied. The first and second spring arms 123, 124 are resiliently deformed, and provide the needed contact force such that the first and second mating portions 122, 121 firmly engage with the pads 31, 41 of the PCB 3 and the IC package 4 respectively. As a result, reliable electrical connection between the PCB 3 and the IC package 4 is provided.

Simultaneously, the engaging portion 125 is bent to press on the connecting portion 111 of the retention portion 11, whereby mechanical and electrical engagement between the engaging portion 125 and the retention portion 11 is attained. Thus two parallel electrical paths are respectively formed between the first and second mating portions 122, 121. A combined impedance of the two electrical paths is less than an impedance of either of the electrical paths in isolation. Thus an overall impedance of the contact 1 is reduced. When the electrical connector 2 is in operation, relatively little heat is generated in the contacts 1. As a result, safe operation of the IC package 4 and the electrical connector 2 is enhanced.

In addition, although the present invention has been described with reference to a particular embodiment, it is not to be construed as being limited thereto. Various alterations and modifications can be made to the embodiment without in any way departing from the scope or spirit of the present invention as defined in the appended claims.

What is claimed is:

1. An electrical contact for electrically connecting two electrically components, the contact comprising:

a retention portion; and an extending portion comprising a first spring arm extending slantingly down from the retention portion and a second spring arm extending slantingly up from the first spring arm, the first spring arm defining a first mating portion at a bottom section thereof, the second spring arm defining a second mating portion at a topmost section thereof and an engaging portion at a free end thereof;

wherein when the first and second mating portions of the contact engage with the electrical components, the engaging portion engages with the retention portion in order to form two electrical paths between the first and second mating portions.

2. The electrical contact of claim 1, wherein the retention portion comprises two legs, and a connecting portion interconnecting the legs.

3. The electrical contact of claim 2, wherein each of the legs forms a plurality of barbs on an outer edge thereof.

4. The electrical contact of claim 3, wherein the first and second spring arms form a substantially "U"-shaped configuration oriented slantwise relative to the retention portion.

5. An electrical connector for electrically connecting two electrical components, the connector comprising:

a substantially rectangular housing defining a plurality of terminal-passages; and a plurality of terminals each received in a corresponding terminal-passage, the terminals each comprising a retention portion, and an extending portion extending from the retention portion, the extending portion defining first and second mating portions respectively disposed outside said corresponding contact-passage for engaging with the electrical components;

wherein the extending portion defines an engaging portion for mating with the retention portion in order to form two electrical paths between the first end second mating portions when the contact electrically mates with the electrical components;

wherein when the first and second mating portions are engaged with the electrical components, respectively, one of the first and second mating portions stands away from the retention portion and the other closes the retention portion.

6. The electrical connector of claim 5, wherein the housing defines four side walls which cooperatively define an opening therebetween.

7. The electrical connector of claim 6, wherein one of the side walls defines a first spring cantilever extending into the opening.

8. The electrical connector of claim 7, wherein an adjacent of the side walls defines two spaced second spring cantilevers extending into the opening.

9. The electrical connector of claim 5, wherein the engaging portion is disposed at a free end of the extending portion.

10. The electrical connector of claim 9, wherein the retention portion comprises two legs and a connecting portion interconnecting the legs, cacti of the legs forming a plurality of barbs on an outer edge thereof.

11. The electrical connector of claim 10, wherein the extending portion comprises first and second spring arms, and has a "U"-shaped configuration oriented slantwise relative to the retention portion.

12. The electrical connector of claim 11, wherein the first spring arm extends slantingly down from the connecting portion, the first mating portion being disposed at a bottom section of the first spring arm.

13. The electrical connector of claim 12, wherein the second spring arm extends slantingly upwardly from the first mating portion, the second mating portion being disposed at a top section of the second spring arm.

14. An electrical connector assembly comprising:

a printed circuit board;

an electrical connector mounted on the printed circuit board;

an electronic package mounted unto the electrical connector;

said connector defining an insulative housing with a plurality of terminal passages extending therethrough in a vertical direction;

a plurality of terminals respectively disposed in the corresponding terminal passages, each of said terminals defining a vertical retention portion, an extending portion split from an upper portion of the retention portion and defining a U-like shape, said extending portion including first and second mating portions respectively exposed on bottom and top faces of the housing and mechanically and electrically engaged with the corresponding printed circuit board and the electronic package; wherein a distal end of the extending portion of each of said terminals defines an engaging portion mechanically end electrically engaged with the retention portion when said terminal is in a compressed condition.

15. The assembly of claim 14, wherein said retention portion essentially is of a U-shaped configuration.

16. The electrical connector of claim 5, wherein the extending portion comprises upper and lower arms, when the first and second mating portions are engaged with the electrical components, respectively, said upper end lower arms substantially construct said two electrical paths, respectively.

* * * * *